United States Patent [19]

Takada et al.

[11] 4,320,730

[45] Mar. 23, 1982

[54] AIR-FUEL MIXTURE RATIO CONTROL DEVICE

[75] Inventors: Shigetaka Takada, Ohbu; Yukihiro Watanabe, Nagoya, both of Japan

[73] Assignee: Aisan Industry Co., Ltd., Aichi, Japan

[21] Appl. No.: 78,739

[22] Filed: Sep. 25, 1979

[30] Foreign Application Priority Data

Oct. 2, 1978 [JP] Japan ..... 53/121317

[51] Int. Cl.[3] ..... F02D 35/00

[52] U.S. Cl. ..... 123/440; 123/489

[58] Field of Search ..... 123/440, 489; 60/276, 60/285

[56] References Cited

U.S. PATENT DOCUMENTS

| | | | |
|---|---|---|---|
| 4,029,061 | 6/1977 | Asano | 123/440 |
| 4,108,121 | 8/1978 | Minami et al. | 123/440 |
| 4,214,558 | 7/1980 | Nishioka et al. | 123/440 |

*Primary Examiner*—Tony M. Argenbright

[57] ABSTRACT

An air-fuel ratio control device for controlling the air-fuel ratio of the mixture to be supplied to internal combustion engine, in which a control level can be made to shift instantaneously even if the engine running condition changes abruptly so that smooth and accurate control of the air-fuel ratio can be performed. Integrators in the control circuit are provided with limiters to place upper and lower limits on the integrated value so as to prevent hunting under the idling condition.

5 Claims, 7 Drawing Figures

AIR-FUEL MIXTURE RATIO CONTROL DEVICE

BACKGROUND OF THE INVENTION

This invention relates to an air-fuel mixture ratio control device for controlling the air-fuel ratio of a fuel mixture to be supplied to an engine with the aid of an exhaust gas concentration signal.

Generally, a method for reducing the noxious components in the exhaust gas from an automobile comprises feeding back information from an exhaust gas sensor to control the air-fuel ratio of the mixture drawn into the engine.

In this method, the components (e.g., CO, $O_2$, $CO_2$, etc). in the exhaust gas are detected by an exhaust gas sensor 1 provided in the exhaust pipe 2, as shown in FIG. 1. A control circuit 3 produces a control signal, containing a proportional element and an integrated element, from a deviation signal which depends upon the deviation between a predetermined air-fuel ratio and the actual air-fuel ratio detected by the sensor. An actuator 4 is actuated by the control signal from the control circuit 3 to control the quantity of fuel and air in a fuel supplying device 5 and thereby maintain the air-fuel ratio at a desired value, e.g., a value at which an exhaust gas purifier 7 functions most effectively to reduce noxious components in the exhaust gas.

In the air-fuel ratio control device of this type, a change in the amount of air intake is accompanied by a change in the degree of influence upon the base air-fuel ratio (the air-fuel ratio when no feedback control is applied) of the mixture supplied from the air-fuel ratio control device (e.g., the carburetor), and the control air-fuel ratio for feedback control of the air and fuel. Hence, the control lever of the feedback control varies as the operating condition of the engine changes. Since the control signal generally contains an integrated element, it takes time for the control lever to shift from the level of idling to that of acceleration such as when the engine is accelerated from the idling condition. During this transition period, accurate control of the fuel ratio cannot be achieved, allowing a large amount of noxious gases to be exhausted.

It has therefore been considered to increase the control speed to reduce the time lag as much as possible. However, since there is a time lag after the air-fuel ratio has been changed in the fuel supplying device until the output of the exhaust gas sensor changes, an increase in the control speed will likely result in hunting under such operating conditions as idling when the quantity of intake air is small.

SUMMARY OF THE INVENTION

This invention has been accomplished to overcome the above-mentioned drawbacks.

It is object of the present invention to provide an air-fuel ratio control device wherein a control level can be made to shift instantaneously according to changes in the engine running conditions. It is another object of this invention to provide an air-fuel ratio control device wherein integrators are provided with limiters so as to prevent hunting under the idling condition.

DESCRIPTION OF THE PREFERRED EMBODIMENTS

This invention relates to a control circuit of the air-fuel ratio control device, and other portions of the device are similar to those of the conventional ones.

Figure 2:
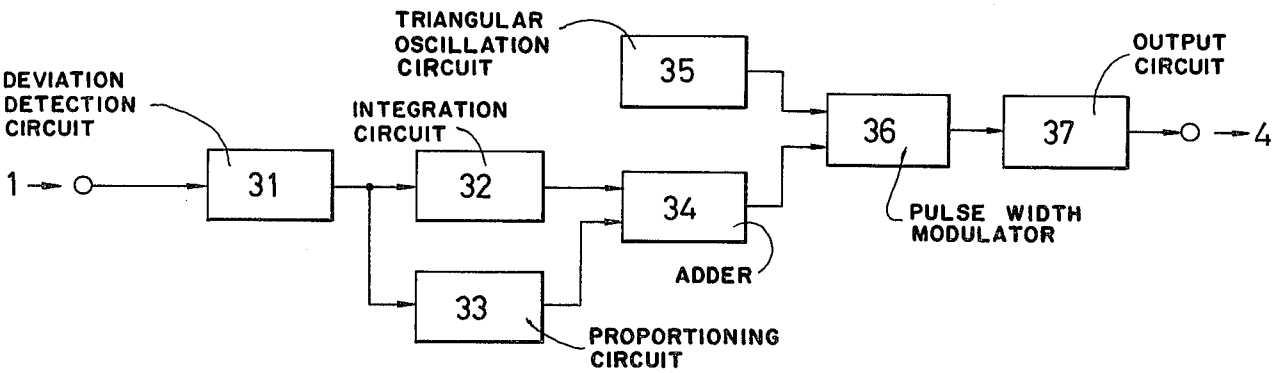
FIG. 2 is a block diagram of a control circuit in an air-fuel ratio control device.

The control circuit is shown in FIG. 2. The signal from the exhaust sensor 1 is converted into a deviation signal in a deviation detection circuit 31. The deviation signal from the deviation detection circuit 31 is then converted into an integrated signal and a proportional signal at an integration circuit 32 and a proportioning circuit 33, respectively. An adding circuit 34 combines these two signals to form a proportional integration signal, which is then compared in a pulse width modulation circuit 36 with a reference triangular wave generated in a triangular oscillation circuit 35 to form a pulse width modulated signal. The pulse width modulated signal is amplified by an output circuit 37 to operate the actuator 4.

Figure 4:
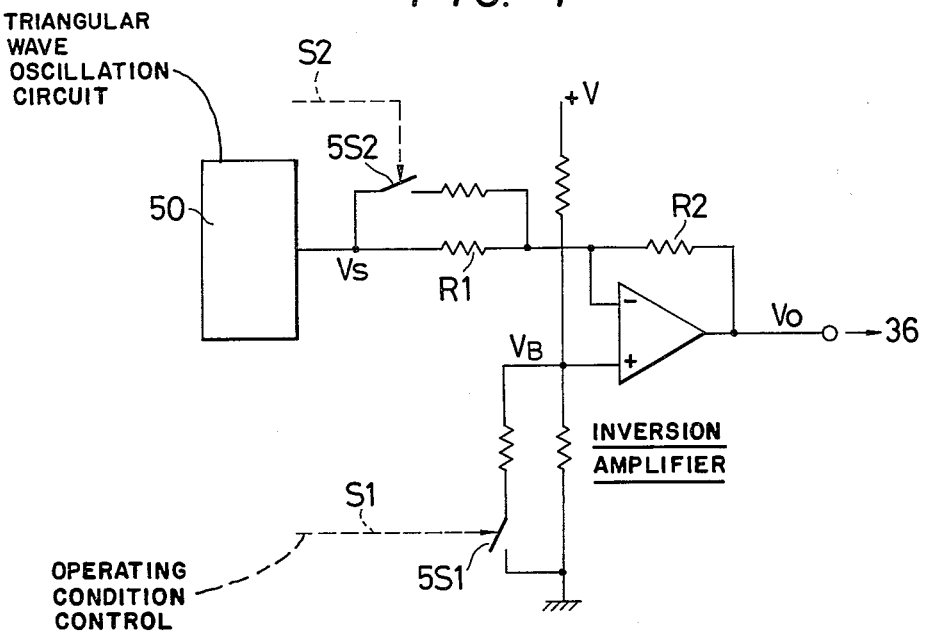
FIG. 4 is a triangular wave oscillation circuit diagram.

As shown in FIG. 4, the triangular wave oscillation circuit 35 is constructed of the conventional triangular wave oscillation circuit 50 with an inversion amplifier added.

Figure 5:
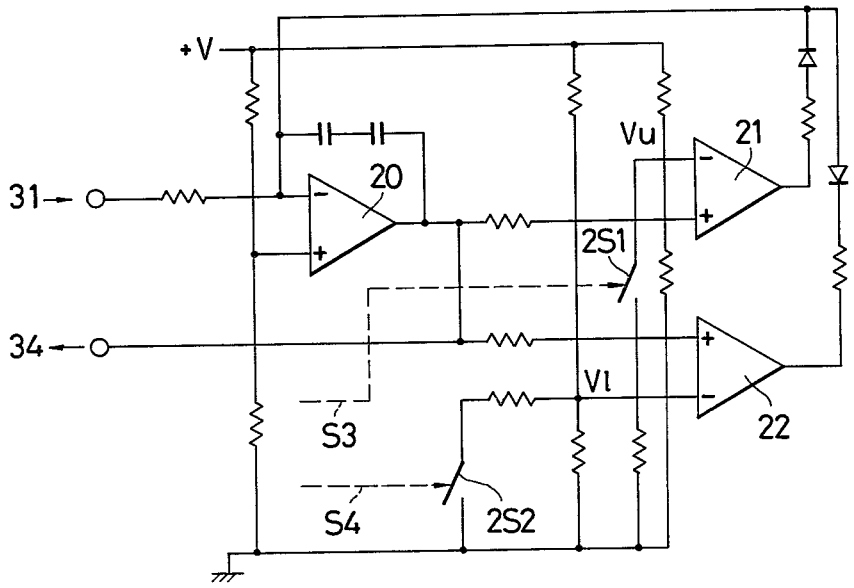
FIG. 5 is a integration circuit diagram.

The integration circuit 32 comprises a integrator and two limiters, as shown in FIG. 5. One limiter (mainly constructed of an operational amplifier 21) determines the upper limit of the integrated value and the other (mainly constructed of an operational amplifier 22) determines the lower limit of the integrated value.

When the switch 5S1 (FIG. 4) is turned on and off by a signal S1 according to the engine operating condition, the voltage VB at the non-inversion input terminal of the operational amplifier varies between two values—high and low. It is of course possible to produce three or more voltage levels at the input terminal depending on the engine running condition. If we let the output of the oscillation circuit 50 and the output of the inversion amplifier be VS and VO, respectively, the relation among voltages VS, VB, VO and resistors $R_1$, $R_2$ may be expressed as $VO=-(VS-VB)(R_1+R_2)/R_1+VB$. This means that when VB changes stepwise, VO also changes stepwise. In this case the amplitude of the triangular wave does not vary.

The upper limit of the integrated value is determined by the inversion input terminal voltage VU. Turning on and off the switch 2S1 by a signal S3 changes over the VU and therefore the upper limit of the integrated value. Likewise, the lower limit of the integrated value can be changed over by changing the VL, i.e., by turning on and off the switch 2S2 by a signal S4.

Figure 6:
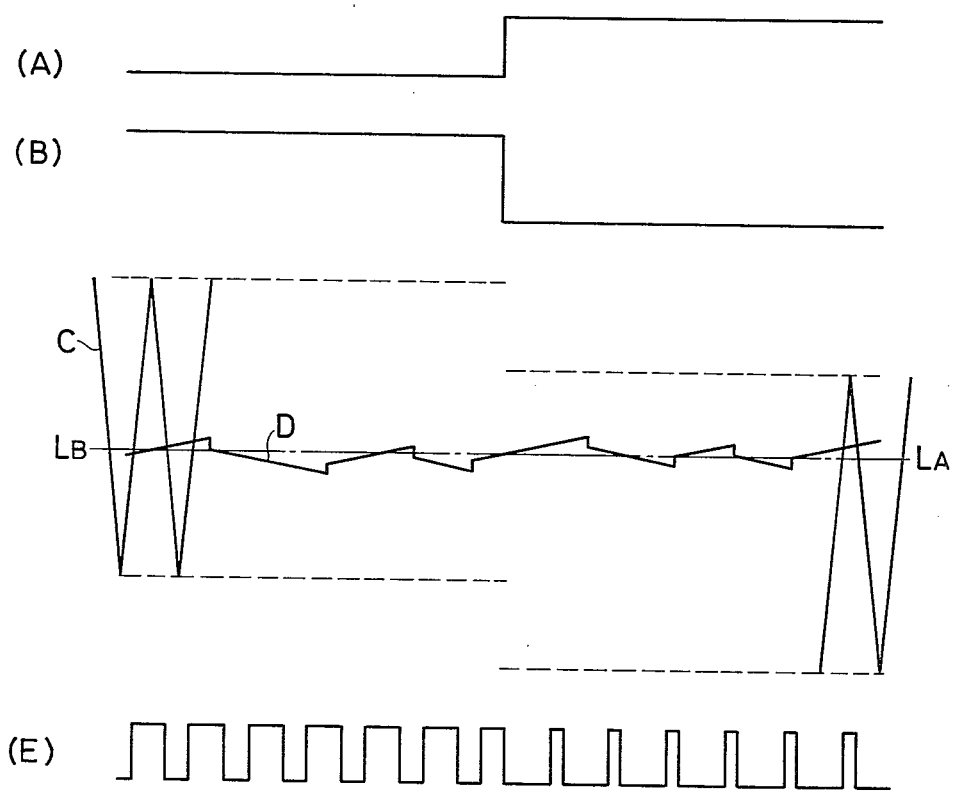
FIG. 6 is diagram showing the center values of the triangular waves when the engine is accelerated from the idling condition.

FIG. 6 shows the center value of the triangular wave when the engine is accelerated from the idling condition. It can be seen in the diagram that the control level shifts from the level of the idling to that of acceleration the instant the triangular wave is switched over. It is also possible to maintain the upper and lower limits of the integrated value at the same levels as the upper and lower limits of the triangular wave by switching over the VU and VL of the limiters simultaneously with the triangular wave.

It is possible to prevent an excessive deviation of an air-fuel ratio from a theoretical value due to a response delay during the idling by adequately narrowing the difference between the upper and lower limits of the integrated value. This will be explained with reference to FIG. 7. If there were no upper and lower limits on the integrated value, the air-fuel ratio of the mixture in the fuel supplying device would continue to increase or decrease even after it has reached and exceeded the theoretical value, until the air-fuel ratio of the mixture as detected by the exhaust sensor reaches the theoretical value, so that the deviation of the air-fuel ratio from the theoretical value would become large. If the integrator is provided with limiters and the upper and lower limits are set at proper values, the value of the air-fuel ratio of the mixture in the fuel supplying device can be prevented from further increasing of decreasing when it reaches the theoretical value. Therefore, the deviation from the theoretical ratio can be prevented.

The deviation from the theoretical ratio during the idling can also be minimized by amplifying the amplitude of the triangular wave and reducing the relative control speed.

Figure 1:
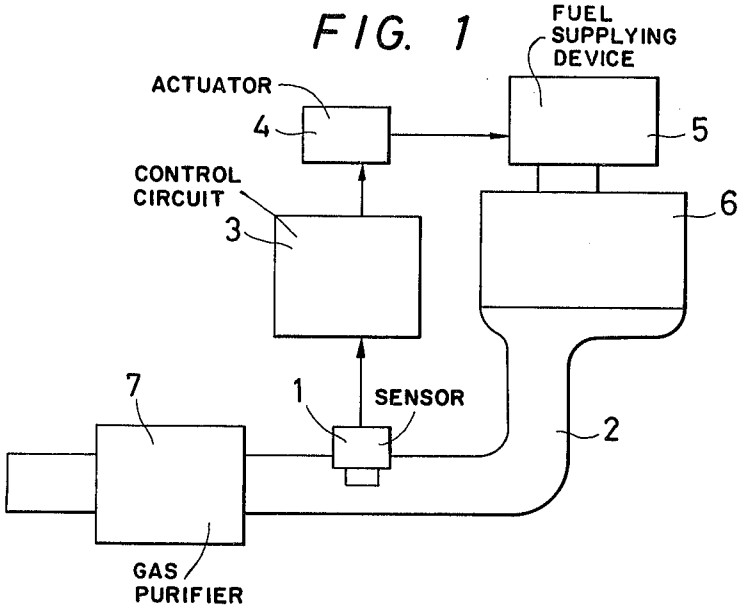
FIG. 1 is a schematic illustration of an air-fuel ratio control device as applied to an internal combustion engine.
Figure 3:
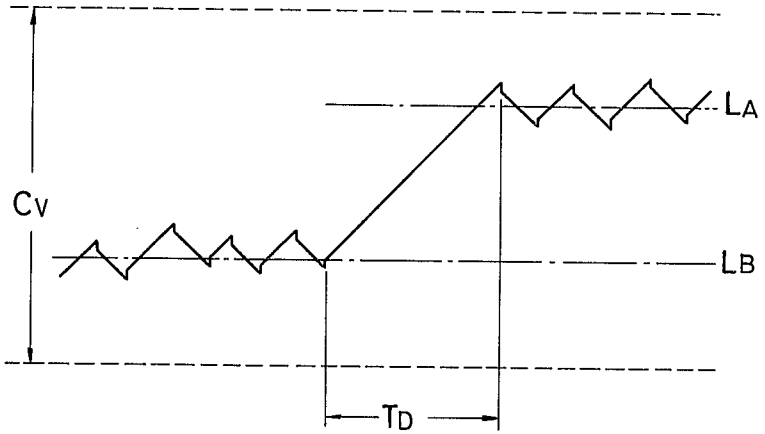
FIG. 3 is a diagram showing a difference in the control lever and a time lag between the idling and the acceleration.
Figure 7:
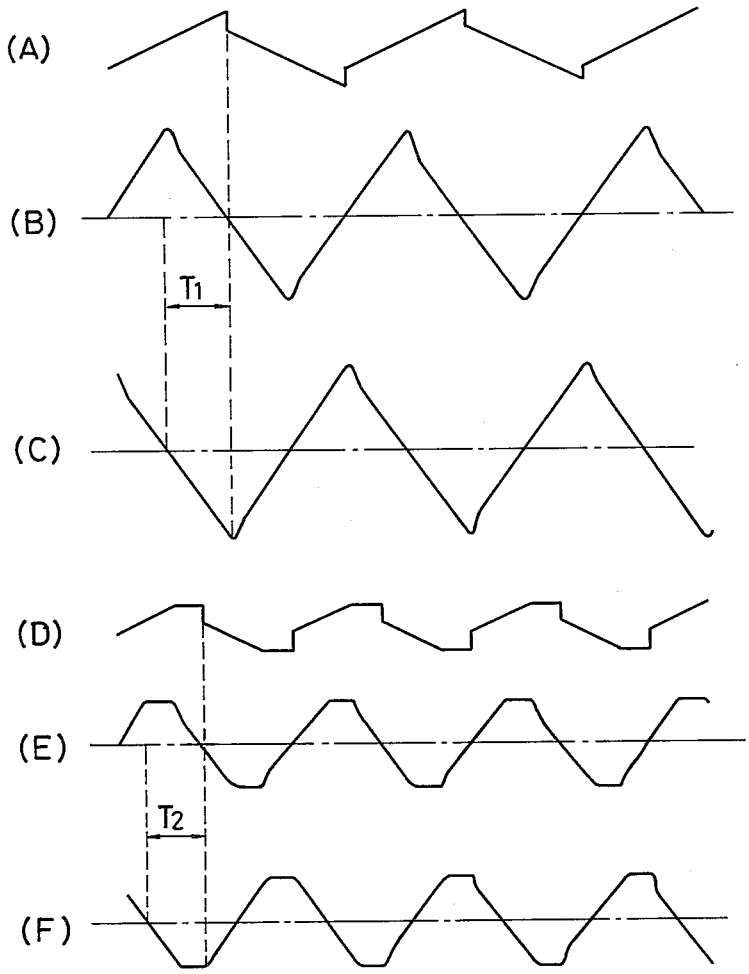
FIG. 7 is a diagram showing triangular waves obtained when a limiter is used with an integrator to reduce hunting.

In FIG. 3, CV is a control width, LA a control level during acceleration, LB a control level during idling, and TD a time delay. In FIG. 4, 5S1 is a switch for switching over the center value of the triangular wave. In FIG. 6, the lower lever of (A) represents the control level during idling and the higher level represents the control level during acceleration. (B) represents VB, C a triangular wave, D a proportional integration signal, LB a control level during idling, LA a control lever during acceleration, and (E) a pulse width modulated control signal. In FIG. 7, (A) represents the proportional integration signal from the integrator without a limiter (an upwardly inclined section represents the air-fuel ratio becoming leaner), (B) an air-fuel ratio of the mixture as detected by the oxygen sensor (an upwardly inclined section represents the air-fuel ratio becoming richer), (C) an air-fuel ratio of the mixture in the fuel supplying device (an upwardly inclined section represents the air-fuel ratio becoming richer), $T_1$ a time delay of the control system, (D) a proportional integration signal from the integrator with a limiter (an upwardly inclined section represents the air-fuel ratio becoming leaner), (E) an air-fuel ratio of the mixture as detected by an oxygen sensor (an upwardly inclined section represents the air-fuel ratio becoming richer), (F) an air-fuel ratio of the mixture in the fuel supplying device (an upwardly inclining section represents the air-fuel ratio becoming richer), and $T_2$ a time delay of the control system.

With this invention, the control level can be shifted instantaneously even if the engine running condition is abruptly changed, so that a quick, smooth, accurate control of the air-fuel ratio can be performed. Further, with the integrators provided with limiters, it is possible to minimize the deviation of the air-fuel ratio from the theoretical value and prevent hunting under the idling condition.

What is claimed is:

1. An air-fuel mixture ratio control device for internal combustion engines, comprising a control circuit, an air-fuel ratio adjusting means for controlling the air-fuel ratio of the fuel mixture drawn into the internal combustion engine by means of an output of said control circuit, said control circuit further comprising, an exhaust gas sensor means disposed in an exhaust system of the internal combustion engine for detecting the density of exhaust gas components, a deviation circuit including a means for detecting the deviation of an output of the exhaust gas sensor means from a reference value and putting out a deviation signal, a triangular wave oscillation circuit means for producing a reference wave having a center value, a proportioning circuit means for producing a proportional signal from said deviation signal, another circuit means for comparing the proportional signal with said reference wave so as to provide a modulated pulse width, an inversion amplifier connected to said triangular wave oscillation circuit and constituting means for varying the center value of the reference wave for pulse width modulation in accordance with operating conditions of the engine to effectively control the air-fuel ratio of the mixture to be supplied to the engine.

2. An air-fuel mixture ratio control device for internal combustion engines, comprising a control circuit, an air-fuel ratio adjusting means for controlling the air-fuel ratio of the fuel mixture drawn into the internal combustion engine by means of an output of said control circuit, said control circuit further comprising, an exhaust gas sensor means disposed in an exhaust system of the internal combustion engine for detecting the density of exhaust gas components, a deviation circuit including a means for detecting the deviation of an output of the exhaust gas sensor means from a reference value and putting out a deviation signal, a triangular wave oscillation circuit means for producing a reference wave having a center value, an integration circuit for producing an integrated signal from said deviation signal, another circuit means for comparing the integrated signal with said reference wave so as to provide a modulated pulse width, an inversion amplifier added to said triangular wave oscillation circuit and constituting means for varying the center value of the reference wave for pulse width modulation in accordance with operating conditions of the engine to effectively control the air-fuel ratio of the mixture to be supplied to the engine.

3. An air-fuel mixture ratio control device for internal combustion engines, comprising a control circuit, an air-fuel ratio adjusting means for controlling the air-fuel ratio of the fuel mixture drawn into the internal combustion engine by means of the output of said control circuit, said control circuit further comprising, an exhaust gas sensor means disposed in an exhaust system of the internal combustion engine for detecting the density of exhaust gas components, a deviation circuit including a means for detecting the deviation of an output of the exhaust gas sensor means from a reference value and putting out a deviation signal, a triangular wave oscillation circuit means for producing a reference wave having a center value, a proportioning circuit means for producing a proportional signal from said deviation signal, an integration circuit for producing an integrated signal from said deviation signal, another circuit means for comparing a proportional integration signal obtained by combining the former two signals with said reference wave so as to provide a modulated pulse width, an inversion amplifier added to said triangular wave oscillation circuit and constituting means for varying the center value of the reference wave for pulse width modulation in accordance with operating conditions of the engine to effectively control the air-fuel ratio of the mixture to be supplied to the engine.

4. The device according to claims 1, 2 or 3, wherein said means for detecting the deviation is a comparator.

5. The device according to claim 1, 2 of 3, wherein said means for varying the center value and said inversion amplifier, respectively, comprises an operational amplifier having one input connected to an output of said triangular wave oscillation circuit and a switch connected to another input of said operational amplifier and to a fixed potential, a resistor connected between an output and one of said inputs of said operational amplifier, said switch constitutes means for being controlled by the operating conditions of the engine.

* * * * *